US007181030B2

(12) United States Patent
Rasmussen et al.

(10) Patent No.: US 7,181,030 B2
(45) Date of Patent: Feb. 20, 2007

(54) WIND NOISE INSENSITIVE HEARING AID

(75) Inventors: Karsten Bo Rasmussen, Hellerup (DK); Peter Frederiksen, Hellerup (DK); Frank Engel Rasmussen, Hellerup (DK); Kim Spetzler Petersen, Hellerup (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 10/501,231

(22) PCT Filed: Jan. 7, 2003

(86) PCT No.: PCT/DK03/00003

§ 371 (c)(1),
(2), (4) Date: Jul. 21, 2004

(87) PCT Pub. No.: WO03/059010

PCT Pub. Date: Jul. 17, 2003

(65) Prior Publication Data

US 2005/0041825 A1 Feb. 24, 2005

(30) Foreign Application Priority Data

Jan. 12, 2002 (DK) ..... 2002 00048

(51) Int. Cl.
*H04R 25/00* (2006.01)

(52) U.S. Cl. ..... 381/312; 381/92; 381/313

(58) Field of Classification Search ..... 381/57, 381/91, 92, 122, 123, 355–361, 312, 313, 381/317, 322, 328, 320, 321, 330
See application file for complete search history.

(56) References Cited

U.S. PATENT DOCUMENTS 4,073,366 A 2/1978 Estes (Continued)

FOREIGN PATENT DOCUMENTS

EP 1017253 7/2000

(Continued)

OTHER PUBLICATIONS

Patent Abstracts of Japan, No. 03106299A of JP 01244295, dated May 2, 1991, entitled "Microphone Device" of Katsunori, Miura.

(Continued)

*Primary Examiner*—Huyen Le
(74) *Attorney, Agent, or Firm*—Dykema Gossett PLLC

(57) ABSTRACT

The invention concerns a hearing aid with at least one primary sound to electric converting transducer converting sounds in the environment into electrical signals and a signal processing unit for amplifying the electrical signal according to the needs of the user and an electrical to sound transducer for receiving the amplified electrical signal and delivering a sound signal to the ear wherein at least one further sound to electrical transducer is provided. The said further transducer has a sensitivity to wind noise which is smaller than the sensitivity to wind noise of the primary transducer and further the signal processing unit has means for detecting the level of wind noise in the signal from the primary sound to electric converting transducer. According to the invention also selecting means are provided for selecting the signal to be amplified from either the primary—or the at least one further sound to electrical transducer.

1 Claim, 1 Drawing Sheet

U.S. PATENT DOCUMENTS

| | | | | |
|---|---|---|---|---|
| 6,327,370 | B1 | 12/2001 | Killion et al. | |
| 6,741,714 | B2 * | 5/2004 | Jensen | 381/313 |
| 2002/0037088 | A1 | 3/2002 | Dickel et al. | |

FOREIGN PATENT DOCUMENTS

| | | |
|---|---|---|
| EP | 1196009 | 4/2002 |
| WO | 9320668 | 10/1993 |

OTHER PUBLICATIONS

Patent Abstracts of Japan No. 05308696A of JP 04113437, dated Nov. 19, 1993, entitled "Wind Noise Sensor" of Michio Matsumoto et al.

* cited by examiner

WIND NOISE INSENSITIVE HEARING AID

AREA OF THE INVENTION

The invention concerns a hearing aid with at least one primary sound to electric converting transducer converting sounds in the environment into electrical signals and a signal processing unit for amplifying the electrical signal according to the needs of the user and an electrical to sound transducer for receiving the amplified electrical signal and delivering a sound signal to the ear wherein at least one further sound to electrical transducer is provided.

BACKGROUND OF THE INVENTION

In hearing aids one of the problems is wind noise picked up by the microphone or microphones. Wind noise is a result of turbulence, some of which is generated around the sound entrance opening of the microphone. It may to some extend be remedied through use of sound penetrating blocking, also called wind screens, over and/or in the sound entrance opening. However this may cause reduced sensitivity of the microphone. Usually hearing aids are produced with an acceptable compromise, which ensures an acceptable sensitivity loss and also an acceptable performance of the microphone system when the user experiences high air velocities around the microphone sound entrance opening. The invention seeks to provide a hearing aid, wherein the best possible sensitivity of the microphone under different wind conditions is ensured.

SUMMARY OF THE INVENTION

This is obtained with a hearing aid of the above kind, whereby said further transducer has a sensitivity to wind noise which is smaller than the sensitivity to wind noise of the primary transducer and whereby the signal processing unit has means for detecting the level of wind noise in the signal from the primary sound to electric converting transducer, and means for selecting the signal to be amplified from either the primary—or the at least one further sound to electrical transducer.

Through this it becomes possible to use a wind noise sensitive sound to electric signal transducer when there is no or little wind noise. And whenever wind noise is present to use a less wind noise sensitive transducer, which is not affected by the wind speeds around the hearing aid.

In a preferred embodiment the hearing aid has the at least one further transducer provided as a MEMS produced microphone on a chip.

In an embodiment of the invention the reduced wind noise sensitivity of the at least one further transducer is provided by the use of a wind filter. Such filters will always cause some reduction of the overall sensitivity, but this only affects the hearing aid whenever the signal from this transducer is used, and it is a small price to pay in order to be able to avoid the highly annoying wind noise.

In another embodiment of the invention the reduced wind noise sensitivity of the at least one further transducer is provided by placing the sound inlet opening of said transducer at a wind protected location on the hearing aid. In many cases this is possible, but such a location often is not ideal for receiving the sound from the surroundings and reduced signal to noise ratio will result from this position of the sound inlet opening.

In a further aspect, the invention concerns a method for processing the signals from sound to electrical transducers in a hearing aid whereby at least one main transducer is provided and whereby one further transducer is provided to be less sensitive to wind noise than the signal from a primary transducer and whereby the level of wind noise in the signal from the primary transducer is monitored and that the level of wind noise is used to determine whether the signal from the less wind noise sensitive further transducer or the signal from the primary transducer is used in the signal processing device for generating the sound signal at the ear of the user.

DESCRIPTION OF A PREFERRED EMBODIMENT

Figure 1:
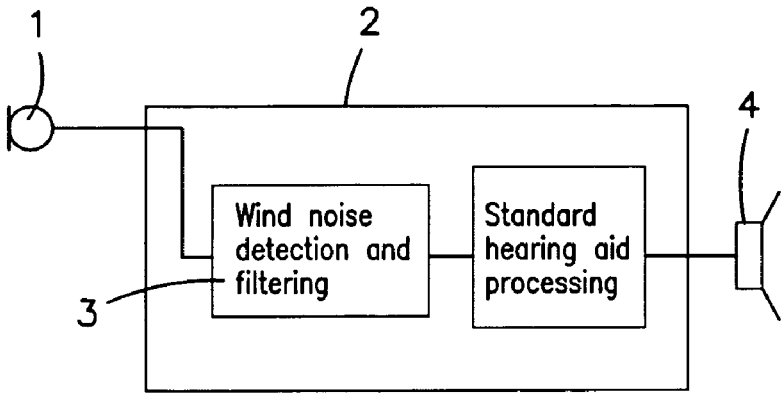
FIG. 1 PRIOR ART
FIG. 1 is a schematic representation of a hearing aid according to the prior art, FIG. 2 a schematic representation of a hearing aid according the invention.

In the prior art hearing aid of FIG. 1 the microphone 1 receives the sound signal from the surrounding and converts it into an electrical signal. In some cases the microphone 1 is replaced by an array of microphones. The signal from the microphone/microphones undergoes signal processing in signal processor 2 whereby spectral and/or temporal content of the signal is used to identify noise or wind noise. Various schemes of signal processing may be used to overcome the noise. This could be high-pass filtering or shift to omni-mode in directional hearing aids. In FIG. 1 a wind noise detector 3 is shown, which receives the signal from the microphone 1. The Wind noise detector 3 may be incorporated in the signal processor 2. A signal processing scheme or filter, which corresponds the best with the detected level of wind noise is chosen, based on the output from the Wind noise detector 3. This prior art technique has the limitation that the wind noise often causes saturation problems in the microphone or microphones and as a result the signal processing designed to eliminate the wind noise is not capable of fully eliminate the wind noise, and when it is attempted to reduce the wind noise this will lead to deterioration of the sound signal.

Figure 2:
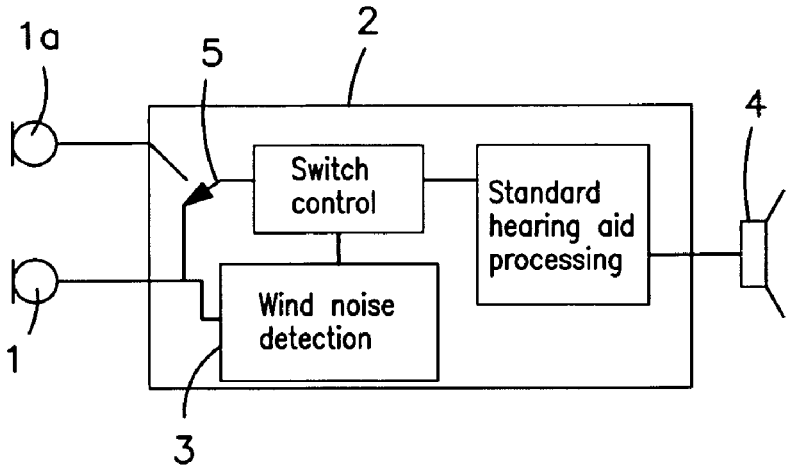

FIG. 2 shows in schematic form an embodiment of the invention, and here a primary microphone 1 is arranged and a further microphone 1*a* is provided, which is less sensitive to wind noise than the primary microphone. Only one primary microphone 1 is shown in FIG. 1 but this could also be an array of microphones. The reduced sensitivity to wind noise of microphone 1*a* is obtained through the use of a microphone placement at a position, which is well protected from wind noise and/or by the use of a wind filter in, or in front of the microphone sound inlet opening. The additional microphone may suffer from a reduced sensitivity and a reduced frequency bandwidth, but this will be a small sacrifice compared to the improved wind noise protection. The improved wind noise protection will not only serve to reduce the wind-induced noise, but also help avoiding saturation problems in the acoustic signal paths. The detection of the wind noise will take place in a wind noise detection algorithm, which may be based on amplitude and phase information from the channels 1 and 1*a* and also for multiple channel systems a cross-correlation between channels may be used for identification of wind noise. Based on the level of wind noise, it is decided in the signal processing unit whether the signal from 1*a* or 1 is to be used and amplified to generate the output signal to the receiver. If a high wind noise level is detected in the signal from microphone 1*a* will be chosen and by means of suitable switching means 5 fed to the amplifier in the signal processing unit. The switching means 5 and accompanying switch control means can be realized in a number of ways well known to the person skilled in the art.

The invention claimed is:

1. Hearing aid with a primary sound-to-electric converting transducer converting environmental sounds into electrical signals, a signal processing unit for amplifying the electrical signals according to needs of a user, a primary electrical-to-sound transducer for receiving the amplified electrical signal and delivering a sound signal to the user's ear, a further sound-to-electrical transducer which has a sensitivity to wind noise which is smaller than the sensitivity to wind noise of the primary transducer, the reduced wind noise sensitivity of the further transducer being provided by placing a sound inlet opening of said further transducer at a wind protected location on a casing of the hearing aid where wind exposure is low and no means for wind protection is provided, and the signal processing unit having means for detecting the level of wind noise in the signal from the primary sound-to-electric converting transducer, and means for selecting the signal to be amplified from either the primary transducer or the further sound-to-electrical transducer.

* * * * *